United States Patent [19]

Hernick et al.

[11] 4,452,340

[45] Jun. 5, 1984

[54] MULTI-STAGE VEHICLE HOIST

[76] Inventors: Jack F. Hernick, 6 Carousel Ct., Toronto, Ontario, Canada, M6B 3M1; Vincent G. Lamont, 2093 Emerald Crescent, Burlington, Ontario, Canada, L7R 1N2

[21] Appl. No.: 190,346

[22] Filed: Sep. 24, 1980

[51] Int. Cl.[3] ..... B66B 9/20

[52] U.S. Cl. ..... 187/8.43; 187/8.64; 254/93 L

[58] Field of Search ..... 187/8.41, 8.43, 8.45, 187/8.64, 8.65, 8.74, 8.59, 17, 8.54; 92/52, 53, 108, 110; 254/2 R, 2 B, 26, 93 R, 93 UA, 93 L, 89 R, 89 H, 90; 108/94–96, 106, 92, 144

[56] References Cited

U.S. PATENT DOCUMENTS

| | | | |
|---|---|---|---|
| 1,911,204 | 5/1933 | Perry | 187/8.54 |
| 1,942,276 | 1/1934 | Clapp | 187/8.43 |
| 2,095,051 | 10/1937 | Bristol et al. | 254/93 L |
| 2,262,121 | 11/1941 | Snider | 187/8.64 |
| 2,381,664 | 8/1945 | Hansen | 187/8.59 |
| 2,892,547 | 6/1959 | Whitaker | 108/106 |
| 2,902,116 | 9/1959 | Ridgeway et al. | 187/8.43 |
| 3,048,237 | 8/1962 | Rutherford | 187/8.43 |
| 3,186,312 | 6/1965 | Hott et al. | 92/53 |
| 3,539,036 | 11/1970 | Halstead | 187/8.41 |
| 3,724,602 | 4/1973 | Hernick | 187/8.45 |
| 4,217,972 | 8/1980 | Jones | 187/8.41 |

*Primary Examiner*—Joseph J. Rolla
*Assistant Examiner*—Kenneth Noland
*Attorney, Agent, or Firm*—Swabey, Mitchell, Houle, Marcoux & Sher

[57] ABSTRACT

A vehicle hoist includes a wheel lift operable to raise and lower a vehicle by its wheels, and a frame lift operable to raise and lower a vehicle by its frame. Each lift is disposed and operable to raise and lower the same vehicle independently of the other, one of the lifts being permanently mounted on the other to be raised and lowered thereby when the other is operated to raise and lower the vehicle. In its preferred form the lifts are hydraulically operated, the skirt of the lower piston being upwardly extended to form a chamber for the piston of the upper lift.

7 Claims, 4 Drawing Figures

MULTI-STAGE VEHICLE HOIST

FIELD OF THE INVENTION

This invention relates to car hoists such as are used in service stations for lifting cars or other vehicles to convenient working levels.

BACKGROUND OF THE INVENTION

In general a car hoist is specifically adapted to lift cars by their frames or to lift them by their wheels. In one form of car hoist the actual lifting is carried out by a centrally disposed ram actuated by fluid pressure. It will be appreciated that where a car is lifted by its wheels, maintenance work on the wheels or suspension is difficultly performed. Conversely, where a car is hoisted by the frame, access to the underbody of the car is usually unduly restricted. It has been heretofore proposed to utilize with the ram both a runway for lifting the car by its wheels and a spider for lifting the car by its frame. In certain of the proposals the decision of whether to employ the runway or spider must be made prior to actuating the ram to hoist the car, so as to interlink the runway and spider suitably. In other proposals the car may be hoisted in one mode; a propping system is then employed to relieve the weight from the ram whilst the spider and runway are inter-converted or unlinked.

Whilst in certain of these other proposals the systems are mechanically quite simple, their installation may be more complex than that of the conventional certral cylinder hydraulic type of car hoist which is currently employed in the automotive service industry.

OBJECTS OF THE INVENTION

The present invention has for object the provision of a car hoist wherein a frame lift and wheel lift are separately and independently deployable to raise and lower a vehicle.

The invention has for further object the provision of a car hoist of the aforesaid type which does not depend upon the use of props or interlinks or the like for operation.

The invention has for still further object the provision of a car hoist of the aforesaid type which may be installed similarly to conventional central cylinder car hoists.

SUMMARY OF THE INVENTION

In accordance with one or more of the above objects, the invention in its broad aspect comprises a multi-stage vehicle hoist including a wheel lift operable to raise and lower a vehicle by its wheels, and a frame lift operable to raise and lower a vehicle by its frame. Each lift is disposed and operable to raise and lower the same vehicle independently of the other, and one of the lifts is permanently mounted on the other to be raised and lowered thereby when the other is operated to raise and lower the vehicle. Preferably the two lifts are disposed in coaxial relationship to each other, with one of the lifts being telescopically mounted on the other. Desirably the first, lower lift includes an elevator wherein the top of the elevator serves a dual capacity. In its first capacity the top of the elevator carries a one vehicle supporting means for raising or lowering either the wheels or the frame of a vehicle. In its second capacity, the top of the elevator forms a casing providing a chamber, e.g. a cylinder, forming part of a fluid motor comprising an upper elevation for the second or upper lift. The upper elevator further comprises an extendible element, e.g. a piston, upon which is mounted the other vehicle supporting means. More concisely stated, the upper elevator includes a fluid operated motor having a casing which is constituted by the top of the elevator forming part of the lower lift.

It is still further preferred that the elevator of the lower lift, otherwise referred to as the lower elevator, comprises a fluid operated motor. In the preferred embodiment to be described, the lower portions of the lower elevator comprise elements of a piston operating in conjunction a further cylinder.

The invention will be further described in relation to the preferred embodiment thereof. Such description is illustrative only of the one arrangement and its operation. Other arrangements within the scope of the invention will be suggested thereby an may indeed by preferred by persons in the art according to particular circumstances.

DESCRIPTION OF PREFERRED EMBODIMENT

Figure 1:
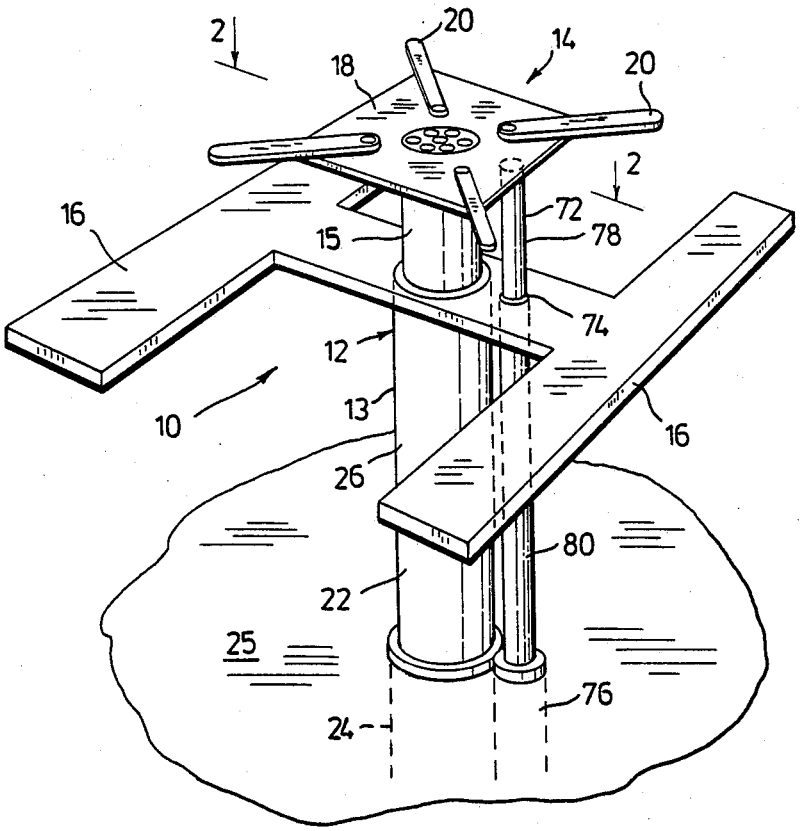
FIG. 1 shows in perspective view from above a vehicle hoist in accordance with the invention in partially extended form.

Referring to the Figures in detail, a two stage hoist constructed in accordance with the invention is denoted generally therein by the numeral 10. Hoist 10 comprises a lower lift 12 including lower elevator 13 and an upper lift 14 including upper elevator 15 mounted thereon and disposed in telescopic relation thereto. In this embodiment vehicle wheel supporting means comprising spaced runways 16 form part of lower lift 12 and vehicle frame supporting means comprising spider 18 form part of the upper lift 14. It should be clearly understood however, that the frame supporting means could form part of the lower lift, and, as a corollary, the wheel supporting means would then form part of the upper lift. In the ensuing description the adjective "lower" as used to qualify lift 12 and elevator 13 is generally replaced by "wheel", and "upper" as applied to lift 14 and elevator 15 is generally replaced by "frame" for the purpose of clarity of description only.

Wheel runways 16 are secured to the wheel elevator 13 adjacent the upper extremity thereof as will be more particularly described later herein. Spider 18 having arms 20 radiating therefrom and pivotally connected thereto so as to be moveable in a horizontal plane for location in a car frame engaging position is secured to frame elevator 15 adjacent the upper extremity thereof. Normally arms 20 are disposed to be below and out of engagement with the frame of a vehicle when the vehicle is stationed on the runways 16 when frame lift 14 is in its lower, retracted position.

Figure 2:
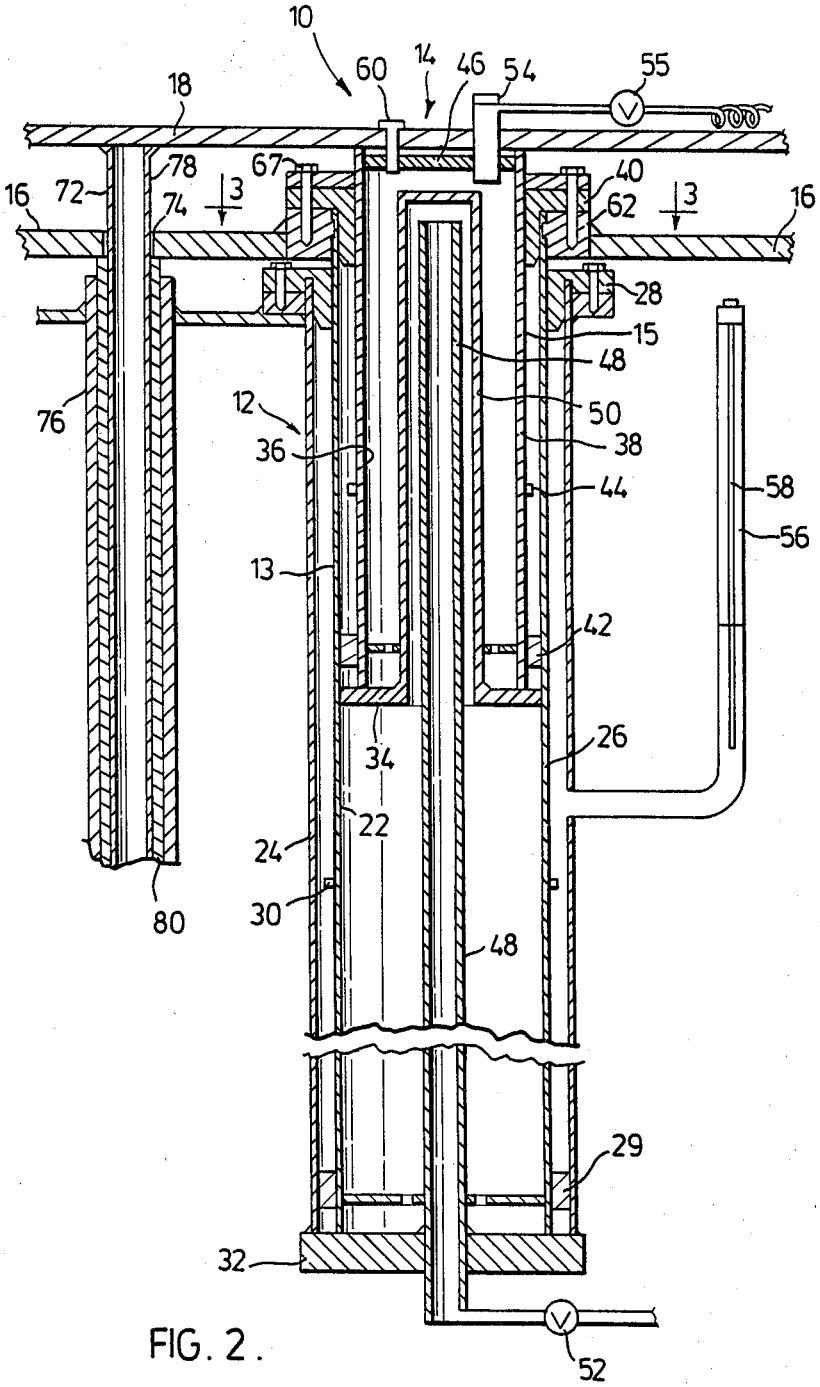
FIG. 2 is taken on 2—2 of FIG. 1 and shows salient features of the elevators.
Figure 3:
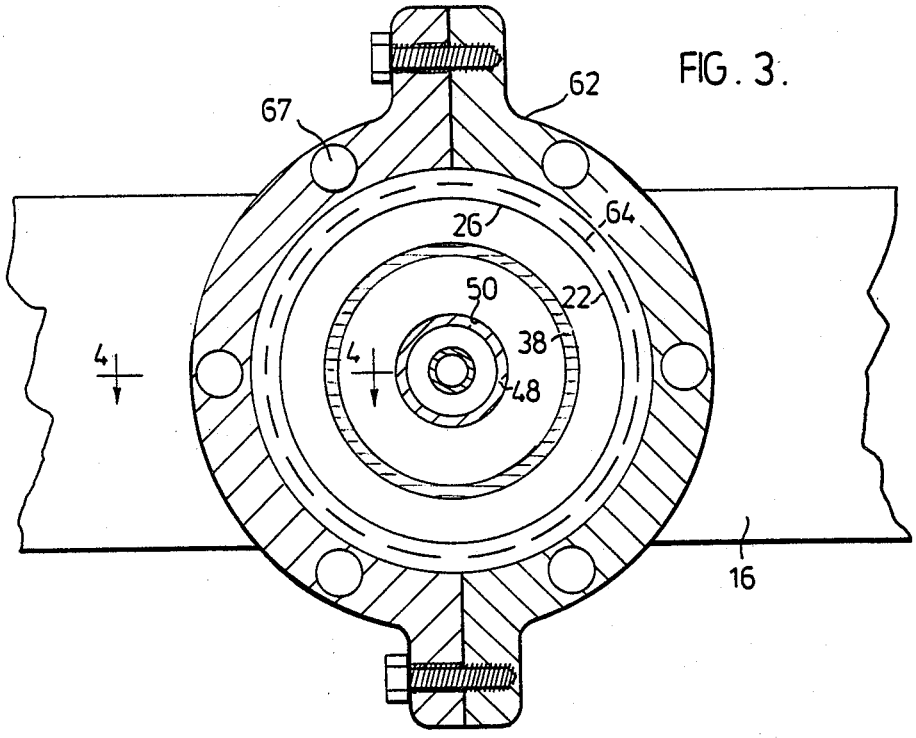
FIG. 3 is taken on 3—3 of FIG. 2.
Figure 4:
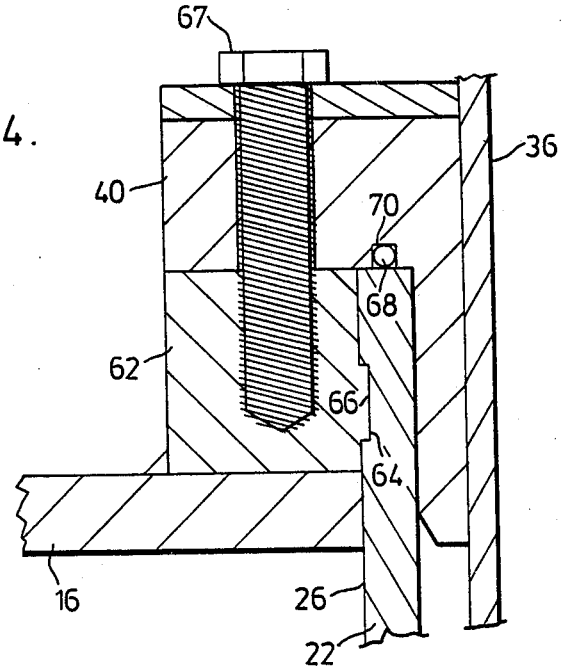
FIG. 4 is taken on 4—4 of FIG. 3.

Referring now more particularly to FIG. 2, wheel elevator 13 comprises a piston 22 subsequently referred to as the wheel piston telescopically received within cylinder 24. Normally cylinder 24 will be embedded in ground indicated in the figures by the numeral 25, hence it may conveniently be referred to as a ground cylinder. Piston 22 includes a skirt 26 and is mounted concentrically in ground cylinder 24 in generally known manner by seal 28 secured to the ground cylinder adjacent its upper end and bearing blocks 29 secured to skirt 26. The upward extent of movement of wheel piston 22 is limited by a stop ring 30 secured to the exterior surface of skirt 26 to interfere with seal 28. The lower extent of movement of wheel piston 22 is normally limited by the lower peripheral edge of skirt 26 contacting base plate 32, which closes off ground cylinder 24. Wheel piston 22 includes a head 34 which locates intermediate the axial ends of skirt 26 to define a cylindrical chamber 36 thereabove. Chamber 36 forms part of frame elevator 15, which also includes a piston 38 therein, referred to subsequently as frame piston. Frame piston 38 is mounted for reciprocal movement within chamber 36 in analogous manner to that in which wheel piston 22 is mounted in ground cylinder 24, i.e. with seal 40, bearing blocks 42 and stop ring 44. A crown 46 closes the upper extremity of frame piston 38.

Elevators 13 and 15 are fluid operated motors, and means is provided for separately supplying pressurized fluid for the operation of the elevators. Generally, and in accordance with current automotive service shop practice, it is preferred that the pressurized fluid be compressed air, but other compressible or non-compressible liquids such as are generally suited for the operation of this type of equipment may be generally employed. Car hoist 10 is particularly adapted for operation by a compressible fluid, such as compressed air, which is non-miscible with the hydraulic fluid normally filling or substantially filling ground cylinder 24 and chamber 36 when pistons 22 and 38 are in their retracted positions. The means for the introduction of compressed air for the operation of wheel elevator 13 comprises a stand pipe 48 which passes upwardly through head 34 to project within chamber 36 so as to approach crown 46 on the underside thereof when the pistons 22 and 38 are retracted. The projecting portion of stand pipe 48 is loosely enveloped in telescoping pipe 50 which is sealed to head 34.

Generally speaking it is preferred that stand pipe 48 be coaxial with wheel piston 22, whereby rotation of wheel piston 22 about its axis, whether by inadvertence or design, will be permitted. The flow of compressed air to and from stand pipe 48 is controlled by valve 52.

Compressed air for the operation of frame elevator 15 is introduced directly into chamber 36 conveniently through crown 46 of frame piston 38, supply conduit 54 sealed to crown 46 in communication with both sides thereof being provided for this purpose, with air line and control valve 55 teeing into conduit 54 on the exterior side thereof.

As observed earlier, elevators 13 and 15 are normally filled or substantially filled, when the pistons 22 and 38 are in their retracted position, with hydraulic fluid. Flow control passages and valves such as are conventionally provided in hydraulically operated car hoists of this nature and which act to limit the rate of ascent and descent of the car hoist are not indicated here, forming no part of the invention as such, but will be understood to be included in commercial embodiments. Additionally, air separation and bleed conduits, passages and other similar control devices are not shown but would normally be provided. For the purpose of maintaining the level of hydraulic fluid within wheel elevator 13, fill conduit 56 is provided in communication with ground cylinder 24 at a point generally below the level desired to be maintained, whereby the liquid level may be monitored in the supply conduit using a dipstick 58 or equivalent device. Hydraulic fluid is conveniently introduced into chamber 36 directly through conduit 54.

Frame supporting spider 18 is conveniently mounted directly to crown 46 of frame piston 38 by bolts 60. Runways 16 are secured to skirt 26 adjacent the upper end thereof through axially split collar 62 which clamps thereabout. One of the mating surfaces is grooved, preferably skirt 26 as herein at 64, the other being provided with a radially projecting shoulder 66 which mates therewith so as to lock collar 62 to preclude relative axial movement thereof. Seal 40 is secured to collar 62 with a plurality of bolts 67. An O ring seal 68 is provided between the upper terminal edge of skirt 26 and seal 40, the seal being provided with an annular recess 70 accommodating the O ring seal.

Optionally an anti-rotational device links lifts 12 and 14 to preclude relative rotation thereof about the central axis. Such device may take any convenient form; in the form illustrated, a shaft 72 is secured to frame lift 14 to be downwardly dependent therefrom, and is received in an opening 74 provided in wheel lift 12. It will be appreciated that as lifts 12 and 14 move to their retracted positions, shaft 72 would interfere with the surrounding ground 25, and for this purpose a ground tube 76 is provided to receive shaft 72 telescopically therein. Desirably, register is maintained between ground tube 76 and shaft 72, hence the shaft will be generally coextensive with the combined extension of elevators 13 and 15. Expediently shaft 72 is itself telescopic, comprising upper portion 78 secured to frame lift 14 and lower portion 80 which secures to wheel lift 12 surrounding opening 74.

What we claim is:

1. A car hoist comprising a first elevator including a first piston having a skirt, a piston head locating intermediate the axial ends of said skirt to define a chamber thereabove, a second elevator comprising a second piston within said chamber, said piston of said second elevator having a head adjacent the upper end thereof;

a tubular member closed adjacent the upper end thereof passing upwardly through the head of said first piston in sealed relation therewith to approach the head of the second piston when said second piston is in its retracted position;

a stand pipe for supplying pressurized fluid to said first elevator, said stand pipe passing upwardly within said first piston through the head thereof to be loosely telescoped by said tube;

vehicle frame support means and wheel support means, one said support means being mounted on said first elevator, the other said support means being mounted on said second elevator;

and means for separately supplying pressurized fluid to said second elevator for the actuation thereof.

2. A car hoist as defined in claim 1, wherein said wheel support means is mounted on said first elevator and said frame support means is mounted on said second elevator.

3. A car hoist as set forth in claim 2 wherein said stand pipe is coaxial with the piston of said first elevator.

4. A car hoist as set forth in claim 2, wherein the vehicle support means is secured to said skirt adjacent the upper end thereof by an axially split collar, and wherein mating surfaces of said collar and said skirt include a radial shoulder and recess thereof to preclude relative axial movement of said collar and said skirt.

5. A car hoist as set forth is claim 4, wherein sealing means including an O ring seal is provided for said collar.

6. A car hoist as set forth in claim 2, wherein said wheel support means and said vehicle frame support means are interconnected by anti-rotational means to preclude relative rotation thereof.

7. A car hoist as set forth in claim 1, wherein means for supplying pressurized fluid for the operation of the second elevator comprises a conduit sealed to the piston head of said second elevator in communication with both sides thereof.

* * * * *